US010731490B2

(12) United States Patent
Widmer et al.

(10) Patent No.: US 10,731,490 B2
(45) Date of Patent: Aug. 4, 2020

(54) GAS TURBINE VANE

(71) Applicant: ANSALDO ENERGIA SWITZERLAND AG, Baden (CH)

(72) Inventors: Marc Widmer, Winterthur (CH); Herbert Brandl, Waldshut-Tiengen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 766 days.

(21) Appl. No.: 15/272,165

(22) Filed: Sep. 21, 2016

(65) Prior Publication Data

US 2017/0081969 A1 Mar. 23, 2017

(30) Foreign Application Priority Data

Sep. 22, 2015 (EP) ..... 15186306

(51) Int. Cl.
*F01D 9/04* (2006.01)
*F01D 25/24* (2006.01)

(52) U.S. Cl.
CPC ..... *F01D 9/042* (2013.01); *F01D 9/041* (2013.01); *F01D 25/246* (2013.01); *F05D 2230/642* (2013.01); *F05D 2240/12* (2013.01); *F05D 2260/30* (2013.01)

(58) Field of Classification Search
CPC ..... F01D 9/042; F01D 25/246; F01D 9/041; F05D 2230/642; F05D 2260/30; F05D 2240/12
See application file for complete search history.

(56) References Cited

U.S. PATENT DOCUMENTS 5,205,708 A * 4/1993 Plemmons ..... F01D 11/08 29/446
5,553,999 A * 9/1996 Proctor ..... F01D 11/08 415/134
5,641,267 A * 6/1997 Proctor ..... F01D 11/08 415/173.1
7,458,772 B2 * 12/2008 Benedetti ..... F01D 9/042 415/173.1

(Continued)

FOREIGN PATENT DOCUMENTS

CN 104541024 A 4/2015
CN 104727862 A 6/2015

(Continued)

OTHER PUBLICATIONS

European Search Report dated Mar. 29, 2016, by the European Patent Office for Application No. 15186306.5.

(Continued)

*Primary Examiner* — Aaron R Eastman
*Assistant Examiner* — Adam W Brown
(74) *Attorney, Agent, or Firm* — Buchanan Ingersoll & Rooney PC

(57) ABSTRACT

The present disclosure generally relates to a guide vane for a gas turbine, and provides for example an innovative guide vane with improved flexibility leading to a reduction of stresses at the interface between the vane platform and the vane carrier. Exemplary embodiments provide only circumferential line contact or point contact between the guide vane and the guide vane carrier.

8 Claims, 9 Drawing Sheets

(56) References Cited

U.S. PATENT DOCUMENTS

| | | | | |
|---|---|---|---|---|
| 8,091,371 | B2 * | 1/2012 | Durocher | F01D 9/065 415/213.1 |
| 10,100,649 | B2 * | 10/2018 | Thomas | F01D 11/08 |
| 2006/0251519 | A1 | 11/2006 | Benedetti et al. | |
| 2009/0123278 | A1 * | 5/2009 | Audeon | F01D 11/08 415/214.1 |
| 2011/0189002 | A1 * | 8/2011 | Panaite | F01D 9/042 415/191 |
| 2012/0128481 | A1 | 5/2012 | Baumas et al. | |
| 2015/0159490 | A1 | 6/2015 | Krueckels et al. | |
| 2015/0176424 | A1 | 6/2015 | Simon-Delgado et al. | |

FOREIGN PATENT DOCUMENTS

| | | |
|---|---|---|
| EP | 1 653 049 A1 | 5/2006 |
| EP | 2 354 460 A1 | 8/2011 |

OTHER PUBLICATIONS

Chinese Office Action dated Nov. 29, 2019 issued in Chinese Patent Application No. 201610840038.9, with English translation (14 pages).

* cited by examiner

GAS TURBINE VANE

FIELD OF THE INVENTION

The present invention generally relates to a guide vane for a gas turbine, and more in particular it provides an innovative guide vane with improved flexibility leading to a reduction of stresses at the interface between the vane platform and the vane carrier.

BACKGROUND

As well known, a standard configuration for a gas turbine envisages a plurality of vanes solidly connected to an outer casing, or vane carrier, which surrounds a rotating shaft guided by blades mounted thereon. In particular, each vane comprises an airfoil which is connected to a vane platform, which is in turn retained into the outer casing. As hot combustion gases pass through the casing to drive the rotating shaft, vanes experience high temperatures.

Generally a vane can be fixed to the outer casing at its outer diameter, in a cantilever fashion, or at its outer and inner diameters (the latter design known as rocking vane).

With reference to FIG. 1, it is schematically shown a stator vane 100 in cantilevered design according to the state of the art, wherein the vane 100 includes an airfoil 103 mounted on a vane platform 104 comprising a leading edge hook 102 and a trailing edge hook 101, which are in turn mounted in a vane carrier 105. Axial and circumferential fixation may be operated either on the leading or trailing edge hooks 102, 101.

With reference to the following FIG. 2, it is shown a stator vane 200 in a "rocking vane" configuration, according to the prior art. In this case, a vane 200 includes an airfoil 203 mounted on a vane platform 204, which in turn comprises an outer single hook 201 fitted into a vane carrier receiving portion 205. Hook 201 provides outer axial, circumferential and radial support and translates axial, radial and circumferential vane loads into the vane carrier 205.

Further, vane 200 is supported axially at its inner diameter 202 by an inner structural component 208, which provides inner axial support. The component 202 is fitted into the vane carrier 205, as schematically indicated in the figure. The vane 200 is pushed against the outer and inner axial vane carrier supports 205, 208 by the axial gas load applied to the airfoil 203.

Due to different thermal expansion of the structural parts of a gas turbine engine in transient modes, the inner and the outer axial supports 205, 208 of the vane 200 will vary axially relative to each other.

This will cause the vane 200 to tilt relative to the vane carrier 205 as shown in FIG. 3. Moreover due to thermal stress in the vane itself, hook 201 may bend in any direction.

In general, according to the teachings of the prior art, vane 200 provides a circumferential hook 201 having a cylindrical space on the outer side and a plane surface on the inner side. The receiving groove in the vane carrier 205 provides outer and inner cylindrical surfaces which create a surface contact 206 at the outer side and an axial line contact 207 at the inner side, as shown in FIG. 4. In order to prevent undesired tilting of the hook 201 in circumferential direction within the receiving groove of the vane carrier 205, clearance between vane hook 201 and vane carrier 205 is typically kept as small as possible. Particularly for rocking-type of vanes, there are several drawbacks of the prior art.

Firstly a thermal deformation of the hook (e.g. bending) may jam the vane inside the groove. This will introduce high forces into the vane or the carrier, which results in a reduced lifetime.

A possible partial solution to such problem might be increasing the clearance, however this may allow for a considerable tilting of the vane in the circumferential direction. Moreover the vane shall be free to rotate around the hook about a few degrees (+/−5° max.) to compensate relative outer and inner support movements which is not possible with an axial line contact and surface contact.

SUMMARY OF THE INVENTION

The object of the present invention is to solve the aforementioned technical problems by providing a gas turbine guide vane as substantially defined in independent claim 1.

Furthermore, the present invention also provides a guide vane carrier as substantially defined in independent claim 8.

Preferred embodiments are defined in correspondent dependent claims.

According to preferred embodiments, which will be described in the following detailed description only for exemplary and non-limiting purposes, the present solution provides a guide vane for a gas turbine which comprises a vane platform and a vane airfoil connected to the vane platform, wherein the vane platform comprises an elongated hook extending in a circumferential direction of the gas turbine and adapted to be housed in a guide vane carrier groove, wherein the guide vane further comprises a first and a second projecting pads located at distal ends of an outer side of the elongated hook and arranged to abut against the guide vane carrier groove, wherein the projecting pads have a rounded shape.

According to a preferred aspect of the invention, the guide vane further comprises a third and a fourth projecting pads, located at distal ends of an inner side of the elongated hook and arranged to abut against the guide vane carrier, the inner side being opposite to the outer side of said elongated hook.

According to a preferred aspect of the invention, the third and a fourth projecting pads have a substantially flat shape.

According to a preferred aspect of the invention, the first and second projecting pads extend each one along a circumferential direction of the elongated hook for a length L which is selected in a range 5%-25% of an entire circumferential length of the elongated hook.

According to a preferred aspect of the invention, the length L is selected in a sub-range 10%-15% of the entire circumferential length of the elongated hook.

According to a preferred aspect of the invention, the length L is 12.5% of the entire circumferential length of the elongated hook.

According to a preferred aspect of the invention, the elongated hook comprises a slot located on the outer side, the slot being adapted to receive a radial locking pin.

According to a further aspect of the invention, it is provided a guide vane carrier which comprises a groove extending in a circumferential direction of the gas turbine and adapted to house a correspondent elongated hook of a vane platform of a guide vane, the groove comprising a first and a second contact portions located on an upper internal surface at respective upper distal ends thereof, the upper internal surface being opposed to an outer side of the elongated hook, wherein the first and a second contact portions have a substantially flat surface in a section view along an axial direction.

According to a preferred aspect of the invention, the guide vane carrier further comprises a third and a forth contact portions located on a lower internal surface at lower distal ends thereof, the lower distal ends being opposed to the upper distal ends and the lower internal surface being opposed to an inner side of the elongated hook, and wherein the third and a forth contact portions have a substantially round surface.

Therefore a novel concept has been invented providing only circumferential line contact or point contact between the guide vane and the guide vane carrier.

The hook is designed thinner than the carrier groove in a middle part which enables bending of the hook without jamming. At the two circumferential ends of the hook, pads are located on inner and outer side to provide local contact with the carrier.

The outer pads are shaped round in axial direction and are rotational-symmetric around engine centre line as well. This provides a linear contact of outer pads and carrier groove outer surface.

The inner pads are flat and tangent to the carrier groove inner surface. The carrier groove inner surface however is shaped round in axial direction. This provides a point contact of the inner pad and carrier at the intersection point of tangents in axial and circumferential direction. According to an aspect of the present invention, the guide vane is allowed to tilt around the hook keeping defined contact at the circumferential ends of the hook even with a limited clearance at the contact location. Such limited clearance is required to minimize tilting of the vane in circumferential direction.

For circumferential locking of the vane in the carrier a radial pin is engaged to a slot in the centre of the hook. Typically, the pin does not carry any axial or radial load, but only transfer circumferential load into the carrier.

BRIEF DESCRIPTION OF DRAWINGS

The foregoing objects and many of the attendant advantages of this invention will become more readily appreciated as the same becomes better understood by reference to the following detailed description when taken in conjunction with the accompanying drawings, wherein.

DETAILED DESCRIPTION OF THE DRAWINGS

Figure 1:
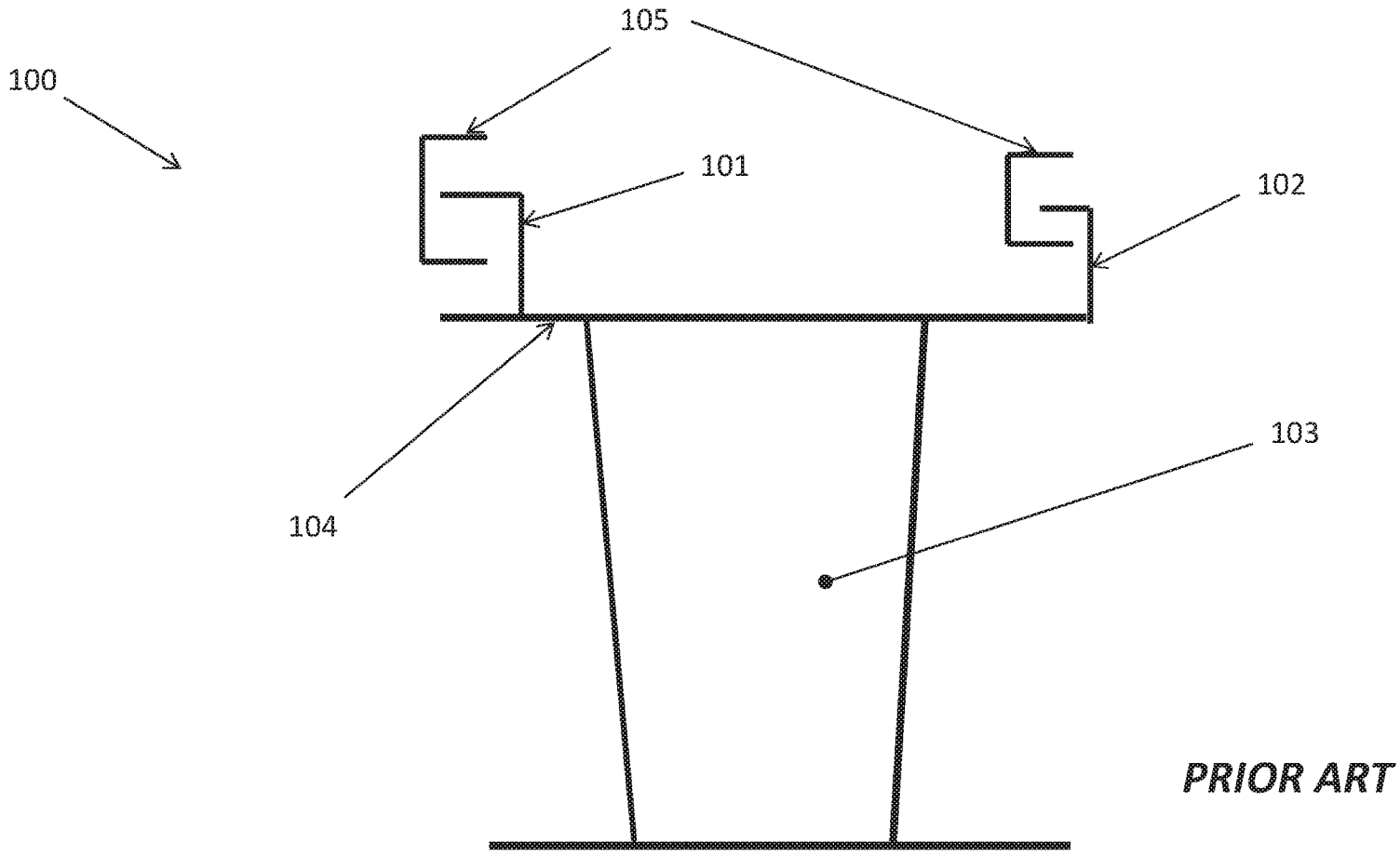
PRIOR ART FIG. 1
FIGS. 1-4 show different kinds of guide vanes fitted into a correspondent guide vane carrier according to the prior art.
Figure 2:
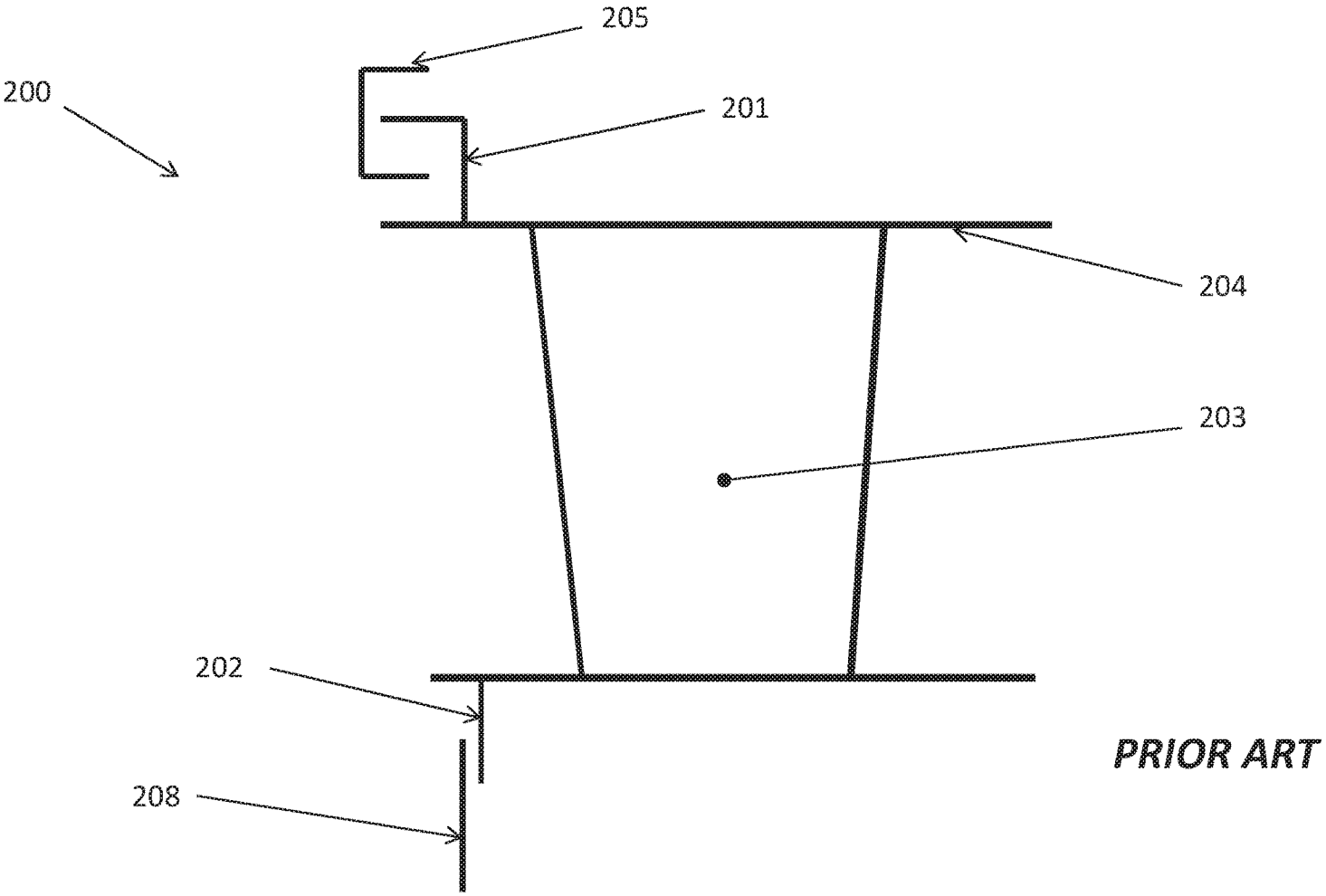
Figure 3:
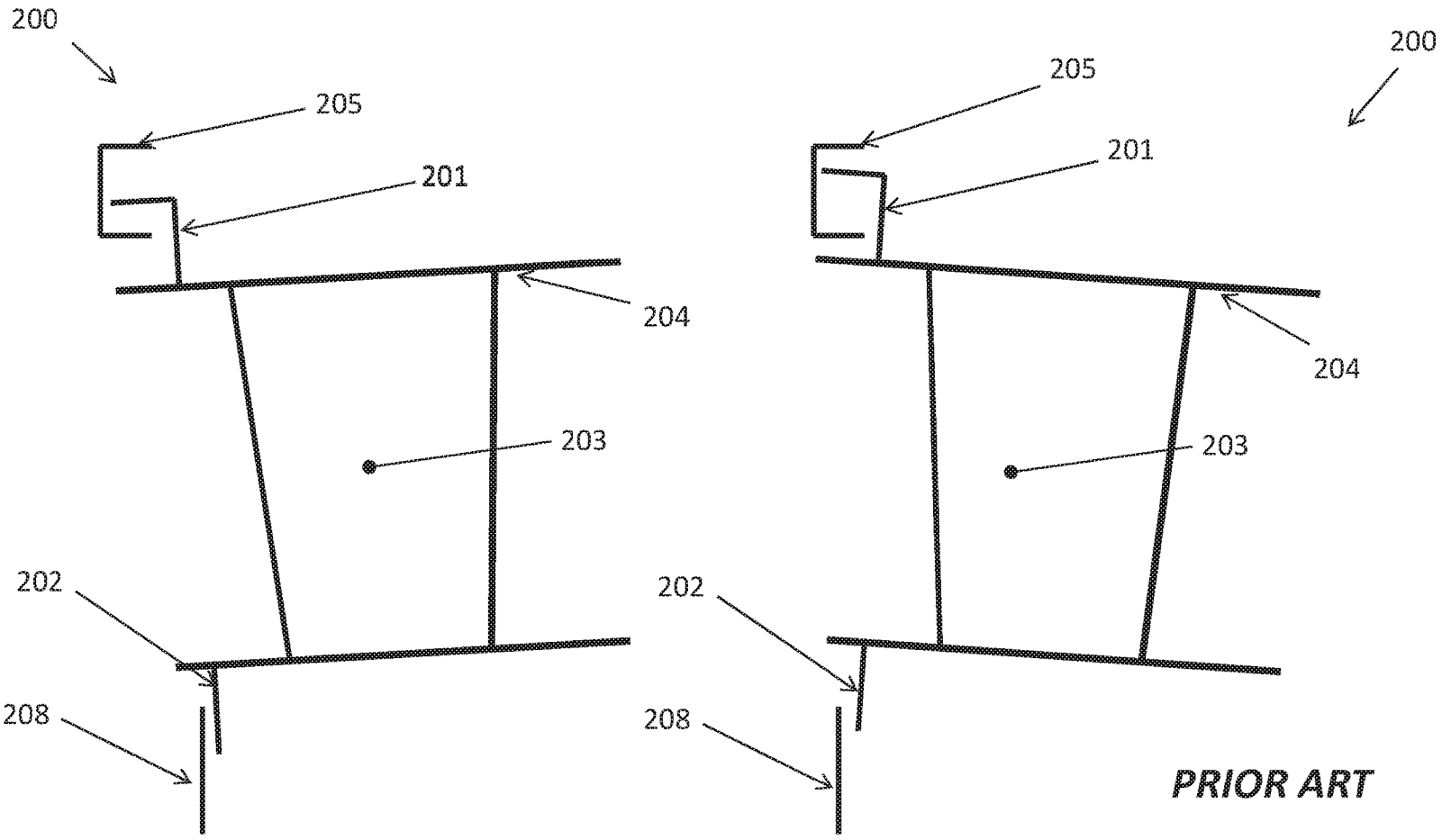
Figure 4:
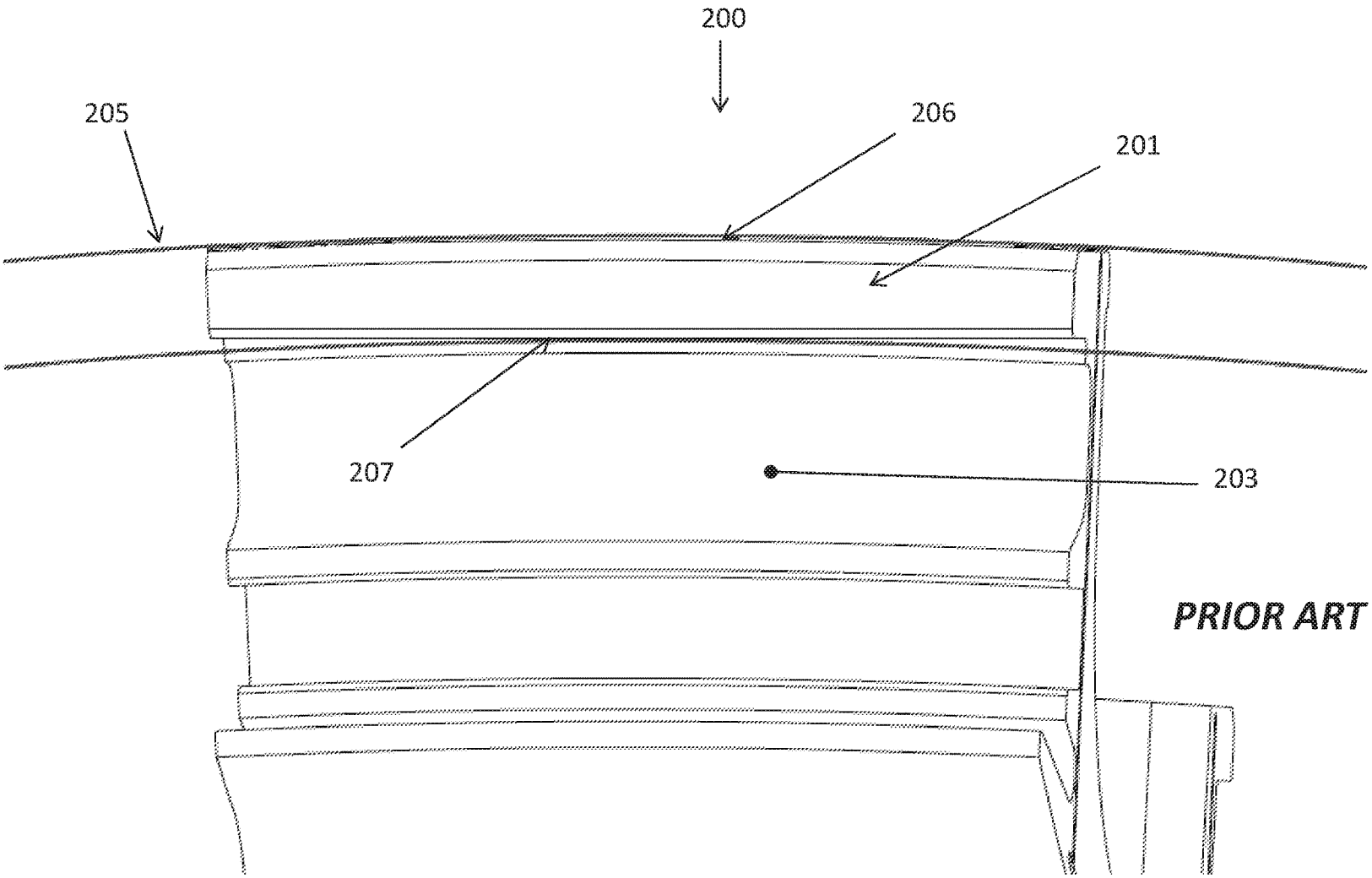
Figure 5:
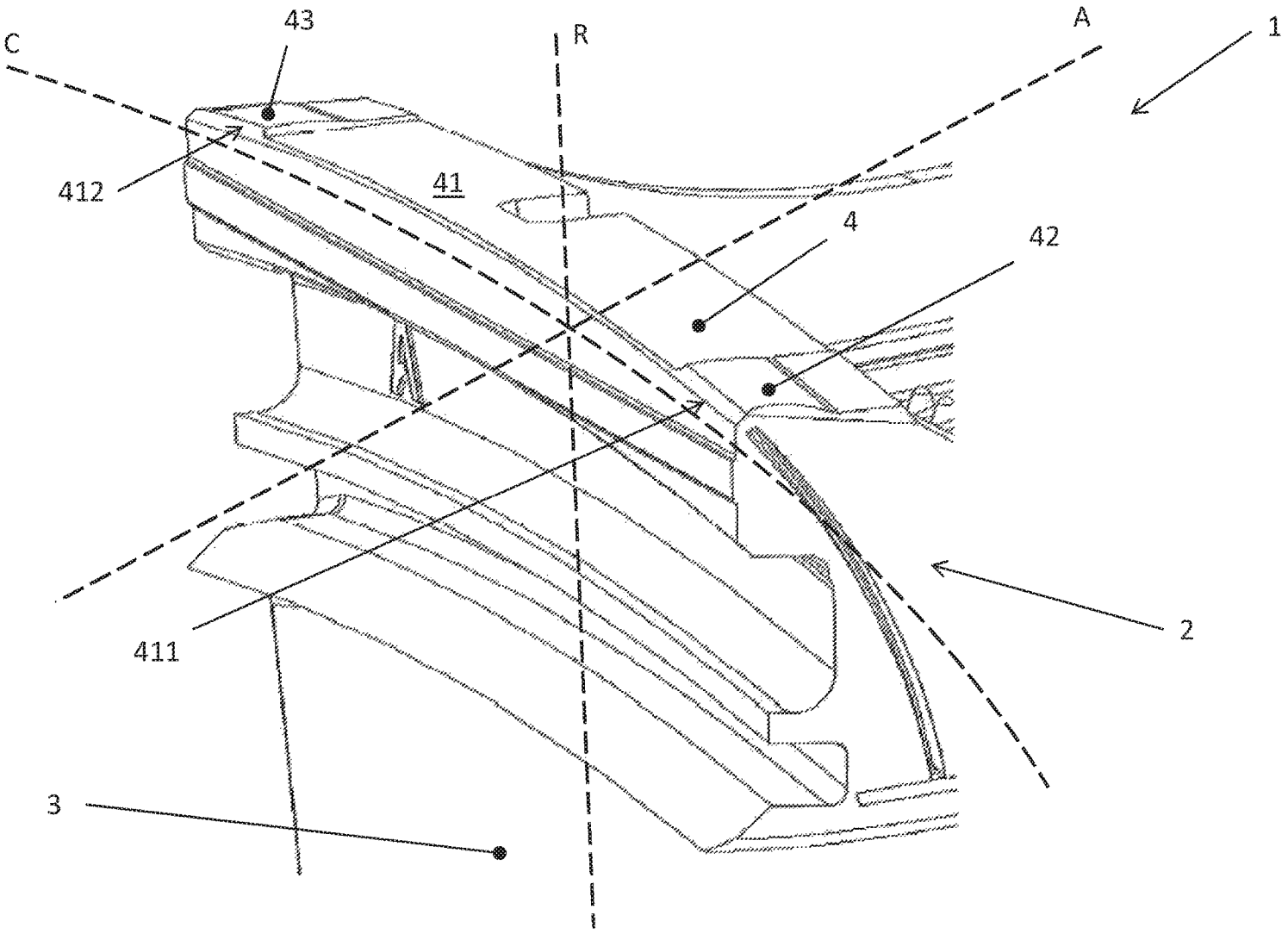
FIGS. 5-6 show perspective views of a hook element of a guide vane according to the present invention.

With reference to FIG. 5, it is showed a guide vane for a gas turbine in accordance with the present invention. Guide vane 1 comprises a vane platform, indicated with numeral reference 2, to which an airfoil 3 is connected. Vane platform 2 comprises an elongated hook 4 which extends along a circumferential direction C of the gas turbine. The vane platform 2 is adapted to be housed into a guide vane carrier (not shown) having a circumferential groove configured to receive the elongated hook 4. A plurality of guide vanes 1 are then inserted in sequence into the vane carrier groove along circumferential direction C, such to dispose a plurality of airfoils 3 along radial directions R and constitute a guide vane stage of the gas turbine. A plurality of stages is then formed along an axial direction of the gas turbine, indicated by axis A in the figure.

The elongated hook 4 further comprises a first projecting pad 42 and a second projecting pad 43, which are located at respective distal ends 411 and 412 of an outer side 41 of the elongated hook 4. According to an aspect of the invention, projecting pads 42 and 43 have a substantially rounded shape.

According to a preferred embodiment, the rounded shape of the projecting pads 42, 43 have a curvature radius of about 40 mm.

Figure 6:
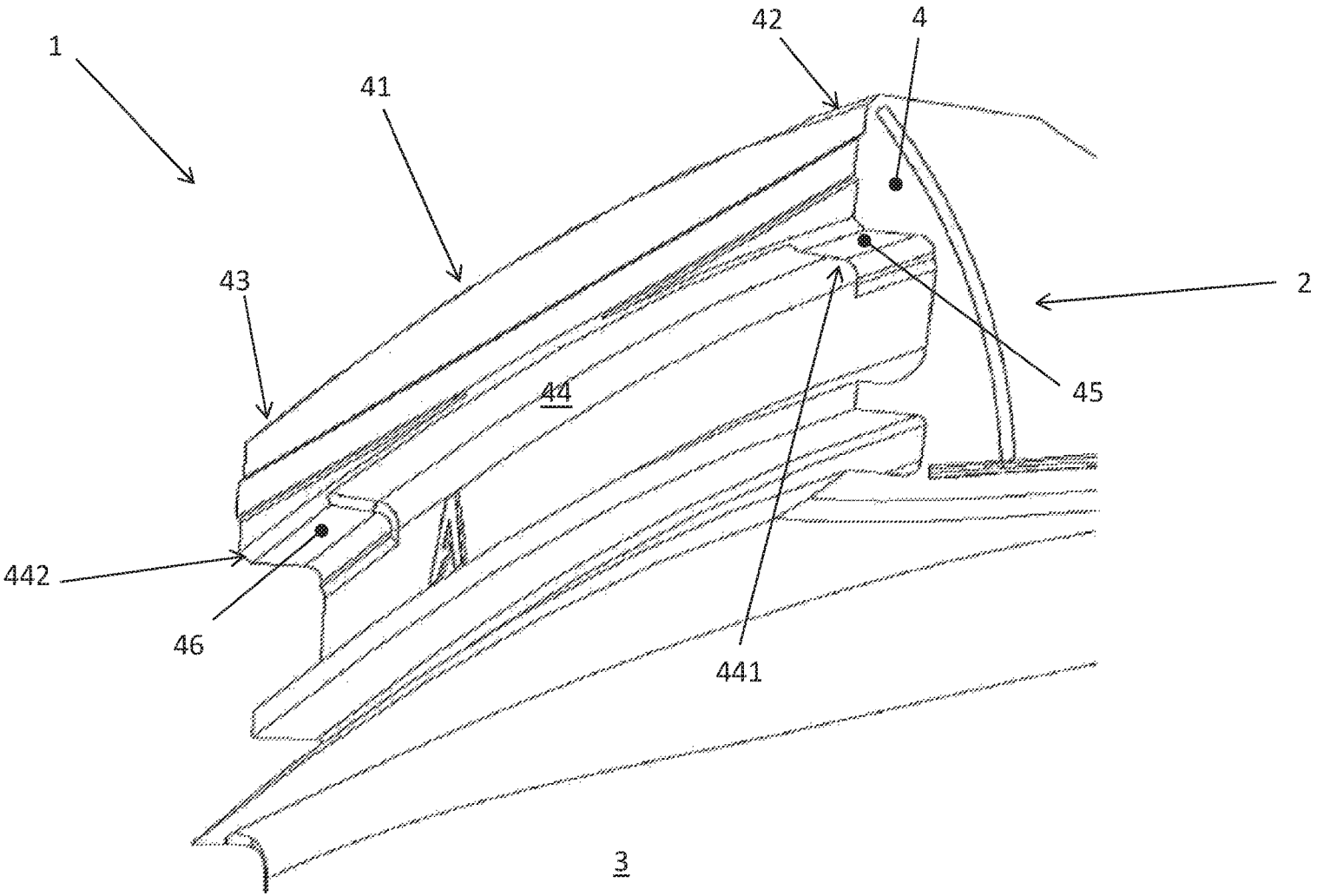

Making now reference to following FIG. 6, it is shown the elongated hook 4 from a different angle, showing an inner side 44 of the same which is opposite to the outer side 41. In particular, elongated hook 4 comprises a third projecting pad 45 and a fourth projecting pad 46, which are located on the inner side 44 of the elongated hook 4 and arranged to abut against the vane carrier groove (not shown). The projecting pads 45, 46 are located at respective distal ends 441, 442 of the inner side 44. Projecting pads 45, 46 have a substantially flat shape, and may be geometrically associated to the shape of a parallelepiped.

Figure 7:
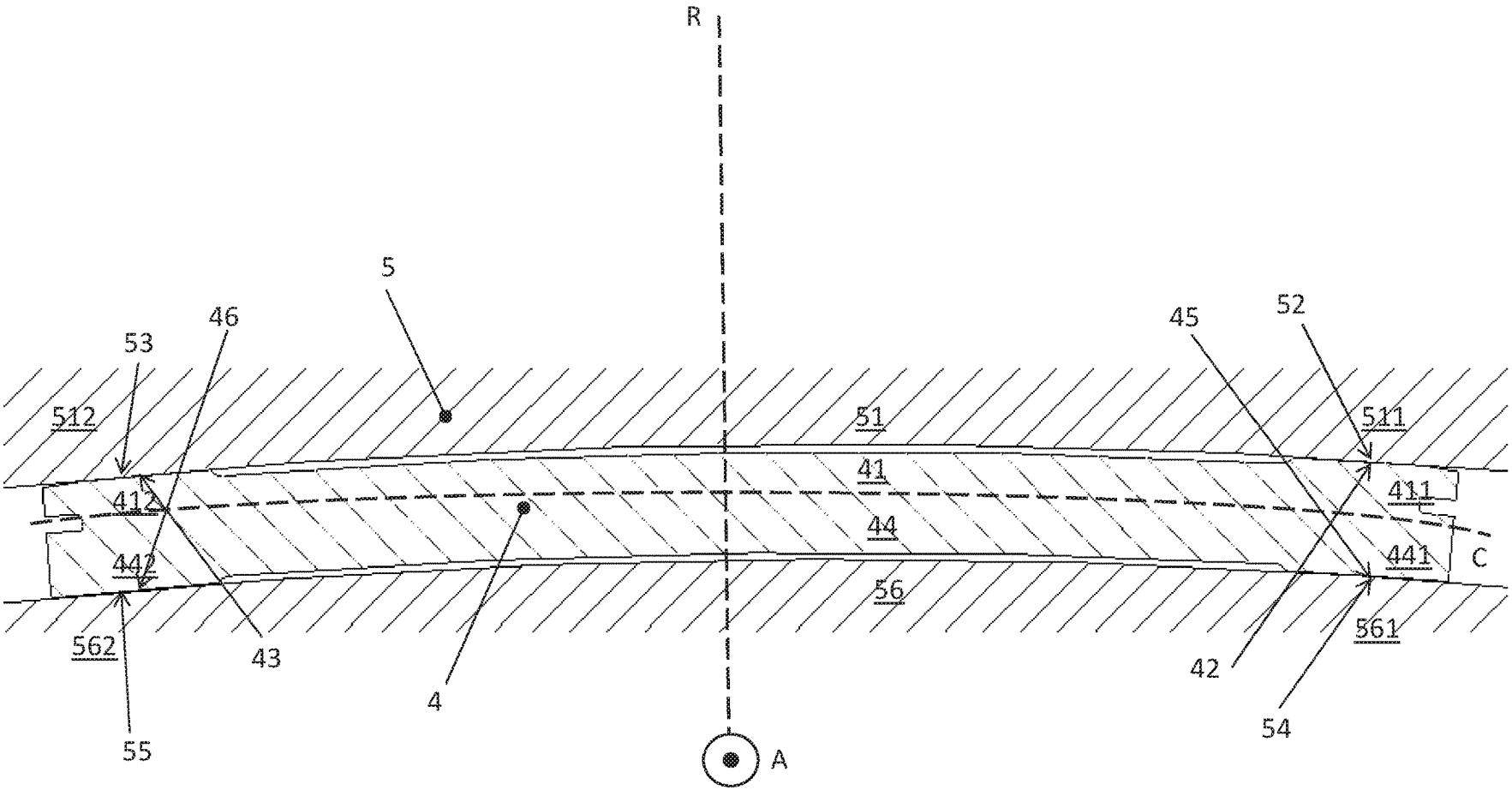
FIG. 7-8 show a section view of a guide vane inserted into a guide vane carrier along a plane perpendicular to an axial direction of the gas turbine.

With reference to the following FIG. 7, it is shown a section along a radial plane of the elongated hook 4, extending along the circumferential direction C, inserted into a guide vane carrier groove 5. In the figure, it is clearly shown that the outer side 41 of the elongated hook faces an upper internal surface 51 of the groove 5, whilst the inner side 44 of the hook 4 faces a lower internal surface 56 of the groove 5.

Carrier groove 5 comprises a first contact portion 52 and a second contact portion 53 which are located on respective distal ends 511 and 512 of the upper internal surface 51. Contact portions 52, 53 abut respectively against projecting pads 42 and 43 of the elongated hook 4.

Similarly, carrier groove 5 comprises a third contact portion 54 and a forth contact portion 55 which are located on respective distal ends 561 and 562 of the lower internal surface 56. Contact portions 54, 55 of the carrier groove 5 abut respectively against projecting pads 45 and 46.

Figure 8:
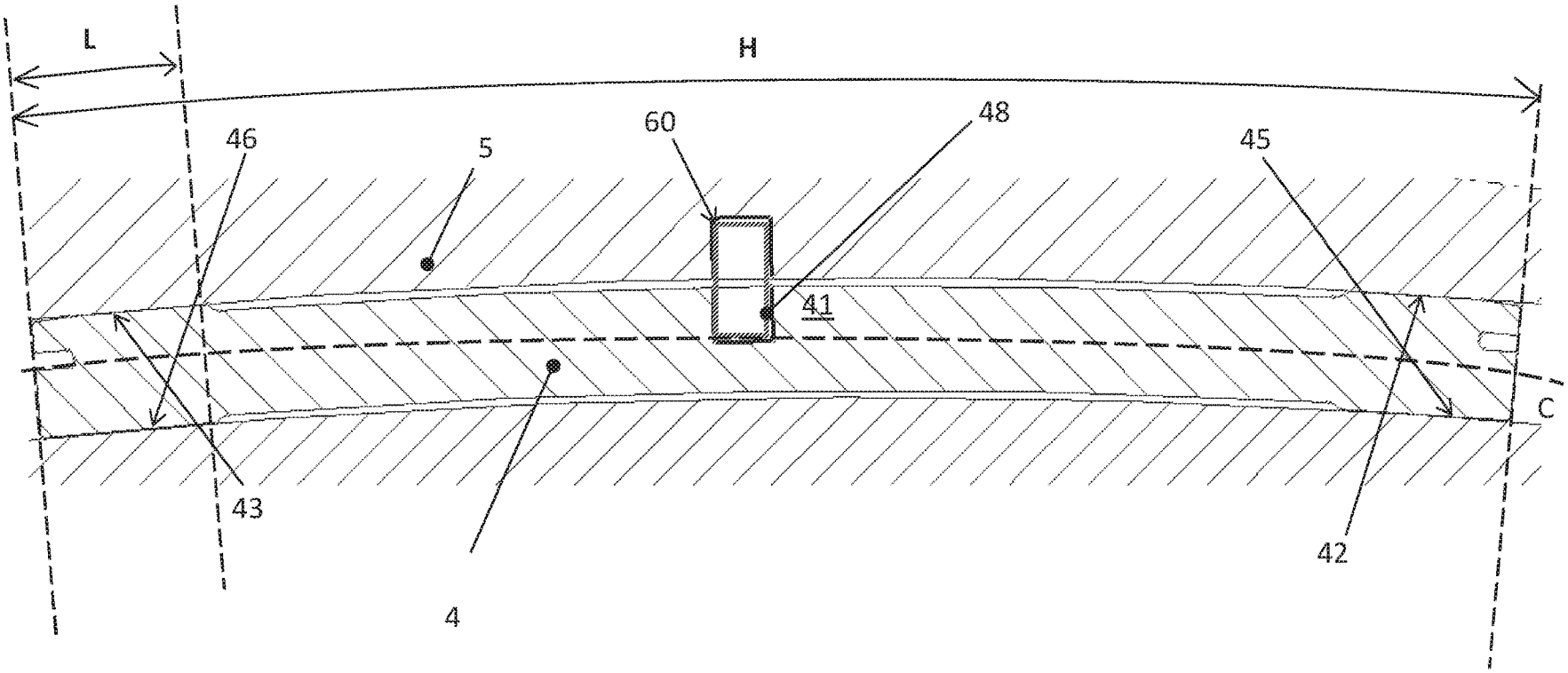

With reference to next FIG. 8, it is still shown in the same view the elongated hook 4 inserted into the guide vane carrier groove 5. According to a preferred geometry, projecting pads 43 and 42 extend each one along the circumferential direction C for a length L which is selected in a range from 5% to 25% of an entire circumferential length H of the elongated hook 4. More preferably, the length L is selected among a sub-range 10% to 15% of the entire length H of the elongated hook 4. Even more preferably, length L is substantially equal to 12.5% of the entire length H.

Still with reference to FIG. 8, the elongated hook 4 comprises a slot 48 located on the outer side 41, which is adapted to receive a radial pin 60. Radial pin 60 is then inserted into a correspondent slot located in the upper internal surface of the carrier groove 5. Pin 60 has a locking function as it prevents the vane platform from sliding circumferentially along the carrier groove 5.

Figure 9:
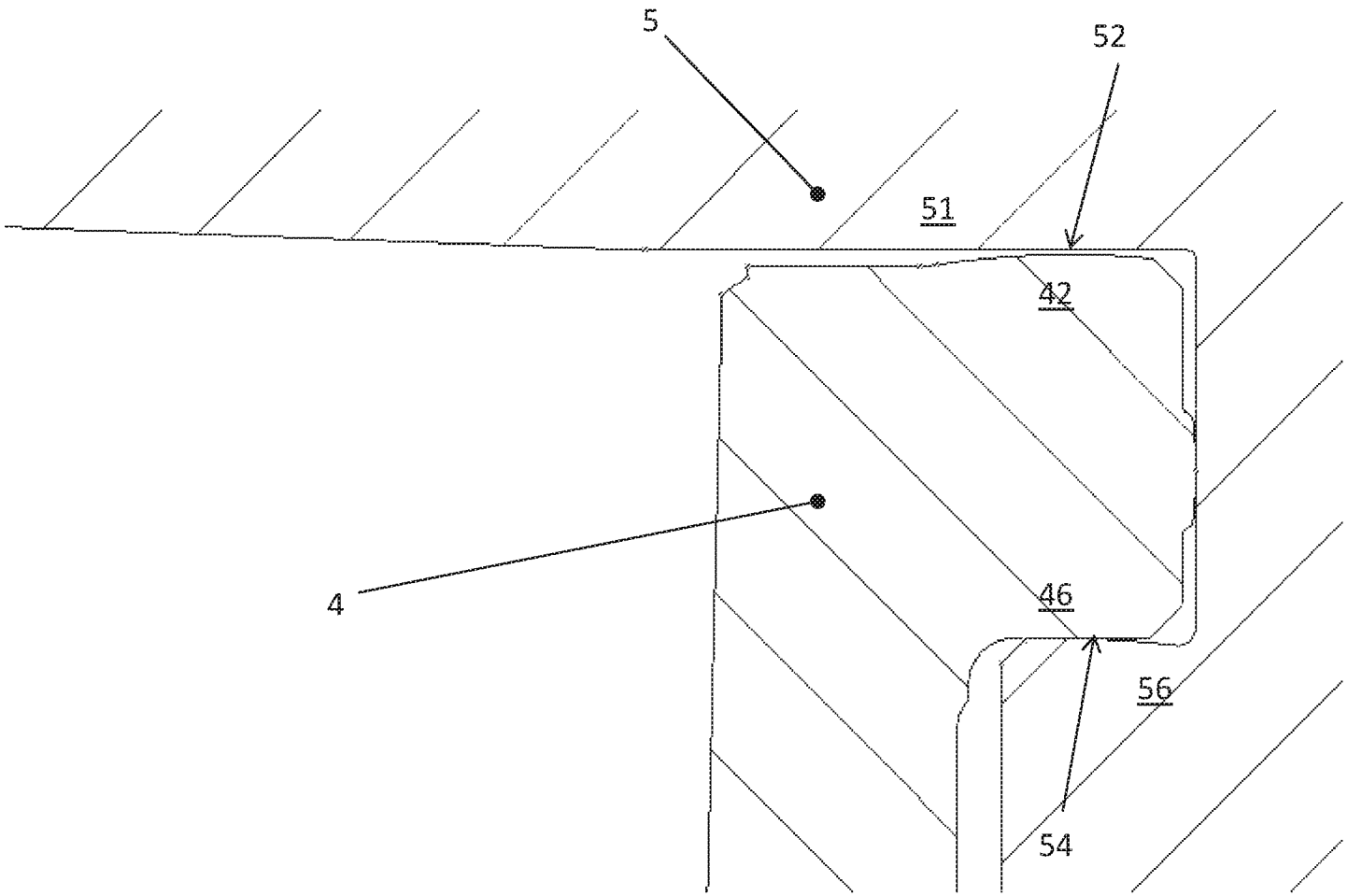
FIG. 9 shows a detail of a hook element according to the present invention when inserted into the guide vane carrier.

Making reference to last FIG. 9, it is shown a lateral section of the hook 4, inserted into the carrier groove 5. In particular, the figure shows rounded projecting pad 42 which abuts against contact portion 52, and flat projecting pad 46 which abuts against contact portion 54.

Advantageously, in order to establish a linear circumferential contact between the groove 5 and the hook 4, contact portion 52, located on the upper internal surface 51 and in contact with rounded pad 42, has a substantially flat surface in a section view along an axial direction. More in particular, a curvature radius of the groove in correspondence of the contact portion 52 is constant along the axial direction.

Moreover, contact portion 54, located on the lower internal surface 56 and in contact with flat projecting pad 46, has a substantially rounded surface.

Same geometry applies for contact surfaces 53 and 55 which abut respectively against projecting pads 43 and 46 (not shown in FIG. 9).

Although the present invention has been fully described in connection with preferred embodiments, it is evident that modifications may be introduced within the scope thereof, not considering the application to be limited by these embodiments, but by the content of the following claims.

The invention claimed is:

1. A gas turbine, comprising:

a guide vane, including:

a vane platform and a vane airfoil connected to said vane platform, wherein said vane platform includes an elongated hook for extending in a circumferential direction of a gas turbine and configured to be housed in a guide vane carrier groove; and first and second projecting pads located at distal ends of an outer side of said elongated hook and arranged to abut against the guide vane carrier groove, wherein a contact surface of said projecting pads have a shape rounded in an axial direction of the gas turbine.

2. The gas turbine according to claim 1, comprising:

third and fourth projecting pads, located at distal ends of an inner side of said elongated hook, project radially inwardly from the inner side and arranged to abut against the guide vane carrier, said inner side being opposite to said outer side of said elongated hook.

3. The gas turbine according to claim 1, wherein said first and second projecting pads extend each one along a circumferential direction of said elongated hook for a length L which is selected in a range 5%-25% of an entire circumferential length of said elongated hook.

4. The gas turbine according to claim 3, wherein the length L is selected in a sub-range 10%-15% of the entire circumferential length of said elongated hook.

5. The gas turbine according to claim 3, wherein the length L is 12.5% of the entire circumferential length of said elongated hook.

6. The gas turbine according to claim 1, wherein said elongated hook comprises:

a slot located on said outer side, said slot being configured to receive a radial locking pin.

7. The gas turbine according to claim 1, comprising:

a guide vane carrier including the guide vane carrier groove extending in a circumferential direction of the gas turbine, said guide vane carrier groove including first and second contact portions located on an upper internal surface at respective upper distal ends thereof, said upper internal surface being opposed to the outer side of the elongated hook, wherein said first and second contact portions have a substantially flat surface in a section view along an axial direction.

8. The gas turbine according to claim 7, wherein the guide vane carrier comprises:

third and fourth contact portions located on a lower internal surface at lower distal ends thereof, said lower distal ends being opposed to said upper distal ends and said lower internal surface being opposed to an inner side of the elongated hook, wherein surfaces of said third and fourth contact portions are substantially shaped round in the axial direction.

* * * * *